US006323819B1

(12) United States Patent
Ergene

(10) Patent No.: US 6,323,819 B1
(45) Date of Patent: Nov. 27, 2001

(54) DUAL BAND MULTIMODE COAXIAL TRACKING FEED

(75) Inventor: Ahmet Ergene, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/680,183

(22) Filed: Oct. 5, 2000

(51) Int. Cl.[7] ..... H01D 5/12
(52) U.S. Cl. ..... 343/786; 333/134; 333/21 A
(58) Field of Search ..... 343/786, 785, 343/776; 333/21 A, 134, 135

(56) References Cited

U.S. PATENT DOCUMENTS

| | | | | |
|---|---|---|---|---|
| 4,100,514 | | 7/1978 | DiTullio et al. | 333/31 |
| 4,258,366 | | 3/1981 | Green | 343/786 |
| 4,547,574 | | 10/1985 | Dvorsky et al. | 544/336 |
| 4,558,290 | | 12/1985 | Lee | 333/126 |
| 4,672,334 | | 6/1987 | Saad | 333/21 |
| 4,704,611 | * | 11/1987 | Edwards et al. | 342/367 |
| 4,801,945 | | 1/1989 | Luly | 343/786 |
| 4,819,005 | | 4/1989 | Wilkes | 343/786 |
| 4,821,046 | | 4/1989 | Wilkes | 343/786 |
| 4,849,761 | | 7/1989 | Thomas | 343/153 |
| 5,003,321 | | 3/1991 | Smith et al. | 343/781 |
| 5,036,332 | | 7/1991 | Thomas | 342/361 |
| 5,202,650 | * | 4/1993 | Krill et al. | 333/34 |
| 5,216,432 | | 6/1993 | West | 343/786 |
| 5,258,768 | | 11/1993 | Smith | 343/786 |
| 5,638,944 | | 6/1997 | Weinstein et al. | 343/776 |
| 5,793,334 | | 8/1998 | Anderson et al. | 343/786 |
| 5,793,335 | | 8/1998 | Anderson et al. | 343/786 |
| 5,818,396 | | 10/1998 | Anderson et al. | 343/786 |
| 5,907,309 | | 5/1999 | Anderson et al. | 343/786 |
| 6,034,647 | * | 3/2000 | Paul et al. | 343/776 |
| 6,081,170 | * | 6/2000 | Enokuma | 333/134 |

* cited by examiner

*Primary Examiner*—Don Wong
*Assistant Examiner*—James Clinger
(74) *Attorney, Agent, or Firm*—Allen, Dyer, Doppelt, Milbrath & Gilchrist, P.A.

(57) ABSTRACT

A dual band multimode coaxial antenna feed has an inner section of longitudinal hollow waveguide having first and second orthogonal mode transducers that interface first and second orthogonally polarized cylindrical waveguide $TE_{11}$ mode signals lying in a first upper (e.g., Ka) frequency band. An outer coaxial waveguide section has a Potter horn surrounding the inner waveguide section, which terminates at a polyrod. The outer section includes third and fourth orthogonal mode transducers that interface orthogonally polarized coaxial waveguide $TE_{11}$ mode signals lying in a second lower (e.g., X) frequency band. A tracking port coupled to the outer coaxial waveguide section provides an output representative of the difference pattern of the radiation profile produced by transverse electromagnetic TEM mode signals generated and propagating in the outer coaxial waveguide. A mode suppressor in the outer waveguide section adjacent its two orthogonal mode transducers locally suppresses TEM signals in their vicinity. A broadband compensated polarizer is installed in the inner waveguide section operating in the high band, and a broadband coaxial compensated polarizer is installed in the outer coaxial waveguide section operating in the low band.

19 Claims, 4 Drawing Sheets

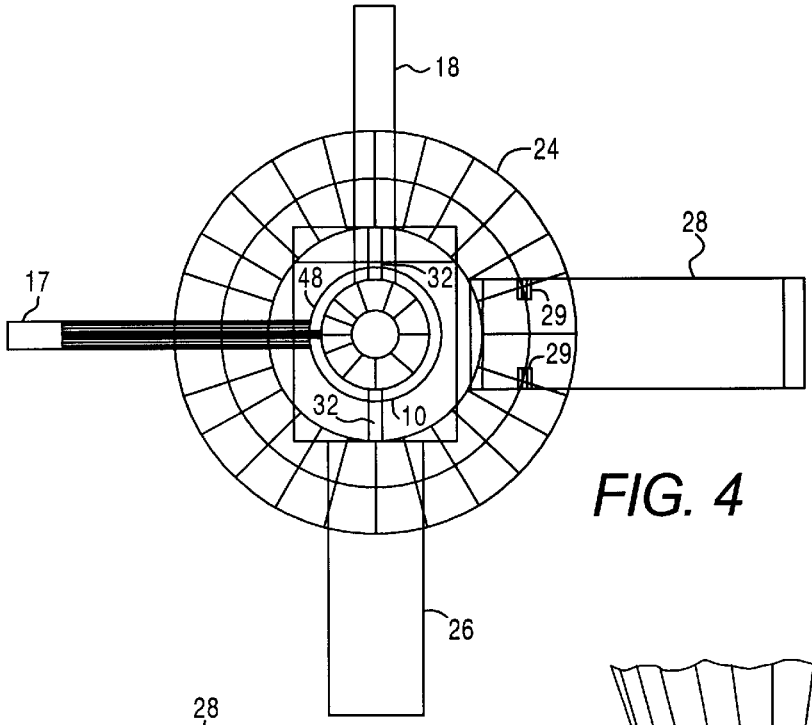
FIG. 4
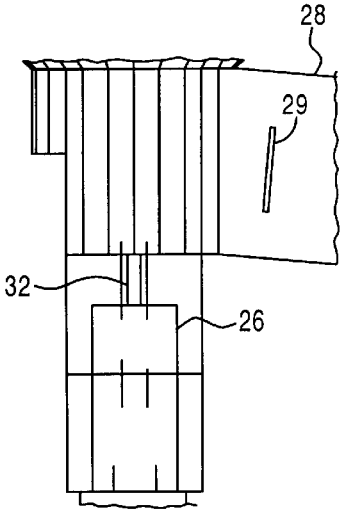
FIG. 5
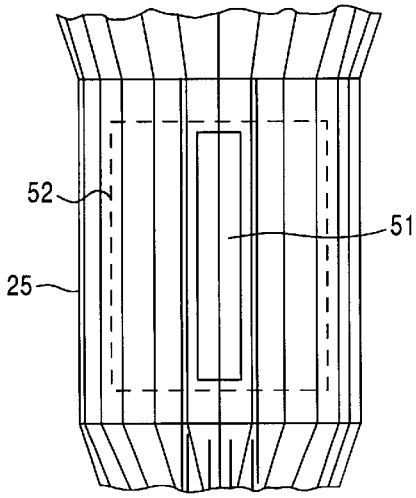
FIG. 7
FIG. 6
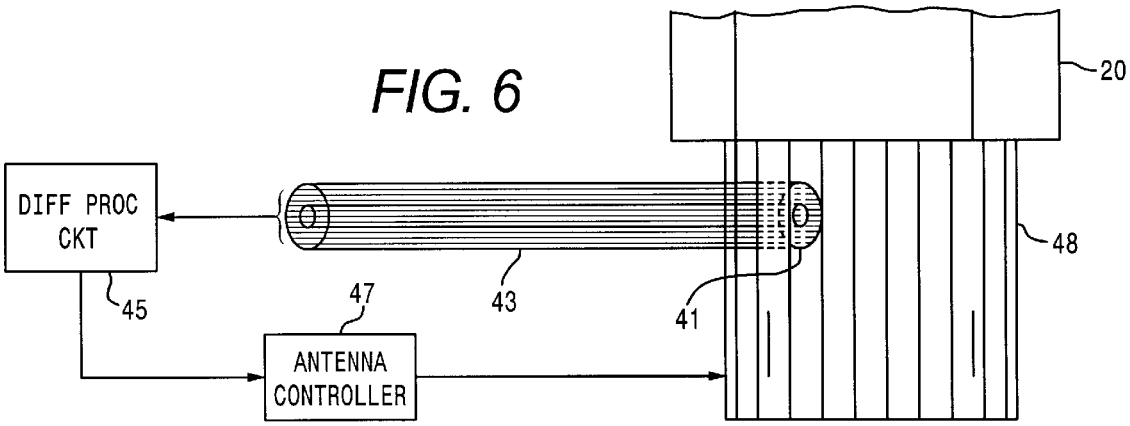

DUAL BAND MULTIMODE COAXIAL TRACKING FEED

FIELD OF THE INVENTION

The present invention relates in general to communication systems and components therefor, and is particularly directed to highly spatially integrated antenna feed horn architecture that is coaxially configured for dual band, multimode operation, including the use of a fundamental TEM mode channel for tracking (steering).

BACKGROUND OF THE INVENTION

Microwave components employed in antenna feed horns limit the operational bandwidth of reflector-based antenna systems, which typically require relatively wide band feeds in order to provide spectral coverage for non-contiguous satellite communication bands. When a single broadband device is used to provide coverage for both transmit and receive sub-bands, it is necessary that the combined bandwidth of the two sub-bands be very wide. For example, in the commercial C-band and Ku-band, as well as the military Ka-band, the ratio of the receive band frequencies to the transmit band frequencies is typically two to three (a forty percent bandwidth). On the other hand, the total transmit and receive bandwidth of the military X-band is relatively narrow at twelve percent, while the total transmit and receive bandwidth of the Extremely High Frequency (EHF) band comprising K and Q bands is considerably wider (at eighty-one percent).

When the transmit and receive bands are too widely separated (as in the case of the EHF band) it is necessary to use a dual horn feed (one feed per band) The problem can become complicated where available deployment space is constrained (such as in a shipborne application), mandating the use of a very compact single feed. In addition, as broadband demand continues to increase, it can be expected that satellites and associated earth terminals will have to operate over increasingly wider bandwidths.

When designing an antenna system that is to be capable of operating simultaneously over multiple bands (such as Ka band and X band, as a non-limiting example), with each band having its own pair of transmit and receive frequency bands, there may be a requirement for a composite feed having separate waveguide ports for each band and configured in a compactly nested architecture—something that is not provided by conventional waveguide horn designs.

Present day multiband feed architectures are typically either multiple feed systems employing frequency selective surfaces, or collocated/coaxial feeds with multiple ports for multiple bands. Because of its complexity, size and lengthy waveguides, the former approach cannot be used for a compact reflector system (such as a ring focus architecture) having a small aperture and small focal length to dish diameter ratio. The latter scheme has been implemented utilizing a nested coaxial feed approach, such as the dual band EHF feed (20 GHz-receive, 44 GHz-transmit) described in the U.S. Patents to Lee, U.S. Pat. No. 4,558,290; and subsequent Patents to Smith et al, U.S. Pat. No. 5,003,321; and Anderson et al, U.S. Pat. Nos. 5,635,944, 5,793,334, 5,793,335, 5,818,396 and 5,907,309.

For further examples of various coaxially positioned combinations of feed horn and cavity arrangements, attention may be directed to the U.S. Patents to Wilkes, U.S. Pat. Nos. 4,819,005 and 4,821,046; West, U.S. Pat. No. 5,216,432 and Weinstein et al, U.S. Pat. No. 5,635,944. Additional illustrations of (non-coaxial) multiband feeds include those described the U.S. Patents to Frosch, U.S. Pat. No. 4,258,366; Luly, U.S. Pat. No. 4,801,945; Gauthier et al, U.S. Pat. No. 4,847,574; and Smith, U.S. Pat. No. 5,258,768.

In the coaxial/nested approach to the dual band feed, where each band is broadband by reason of having separate transmit and receive bands, the problem of effective launching, transmission and radiation had previously only been successfully solved by employing a turnstile launching mechanism. In this approach, a pair of orthogonally polarized ports are employed, each with a pair of oppositely positioned launching ports, with a total of four launching ports—thus, the name turnstile. This has been the only effective way to forcibly balance the excitations and launch the coaxial $TE_{11}$ mode avoiding the fundamental TEM mode and the higher order modes. The turnstile mechanism with external waveguides T's and phase shifters have also provided for a polarizer to generate circular polarization.

A major shortcoming of a turnstile configured approach is the significant size, weight and complexity of its associated waveguide 'plumbing'. In order to effectively eliminate such plumbing, first, it is necessary to provide some form of design having a pair of singularly launched ports, one for each on of the two orthogonal polarizations, into a coaxial waveguide without exciting higher order modes or the fundamental TEM mode. Secondly, it requires a novel design of a broadband polarizer implemented internally (rather than externally) of the cylindrical waveguide. As will be described below, the present invention successfully accomplishes these objectives.

In addition to collimating a beam, it is customarily required that the antenna system be capable of tracking its associated satellite, as this not only ensures an uninterrupted link, but also assists in initial acquisition of the satellite. For this purpose, it is customary practice to either use a difference pattern (if available) in the antenna's directivity profile, or physically dither the main beam about the link axis which can be very difficult in the case of a platform that is dynamic and/or has significant inertia. Other forms of tracking on the main beam include sequential lobing and nutating feeds, which have a higher error slope at the expense of beam offset loss. The use of a difference pattern is preferable as it can provide an error-slope for a very accurate and rapid response tracking scheme, and can be used in both monopulse and pseudomonopulse systems.

In a multiband system that does not employ co-located feeds, but instead has a dual reflector architecture with a frequency selective surface to partition its aperture into real and virtual focal points, a pointing error between the two feeds may occur. When one of the bands has a much high frequency band, it may be necessary to track at the higher frequency band, and rely on the broader beam coverage of the lower frequency band to avoid a pointing loss. As the band of operation becomes higher, as in the case of fixed size, Ka-band reflector systems, for example, the antenna beamwidth becomes very narrow, so that using the main beam for tracking introduces the issues of tracking stability and speed.

For examples of literature describing various types of tracking feeds, attention may be directed to the U.S. Patents to Thomas, U.S. Pat. No. 4,849,761 and 5,036,332, and an article by P. Patel, entitled: "Design of an Inexpensive Multi-Mode Satellite Tracking Feed," IEEE Proceedings, 1988.

Further, for examples of literature describing what may referred to as 'compensating' type polarizer structures, that employ one or more sets of vanes or fins and pins configured as conductive or dielectric elements, attention may be directed to the U.S. Patents to DiTullio, U.S. Pat. No. 4,100,514 and Saad, U.S. Pat. No. 4,672,334.

SUMMARY OF THE INVENTION

Pursuant to the present invention, the above-discussed problems of conventional multiband feeds for reflector antennas are successfully addressed by a highly spatially integrated feed horn architecture capable of dual band, multimode operation, and providing a resilient dominant TEM mode channel for difference pattern-based tracking, the same mode locally suppressed in the launching of the sum-patterns.

The dual band, multimode feed horn of the invention is configured as a very compact, coaxial structure comprised of an interior section of generally longitudinal (e.g., cylindrical) hollow waveguide, that extends along the longitudinal axis of the feed, and is coaxially surrounded by an outer section of coaxial (e.g., cylindrical), stepped waveguide. The interior hollow waveguide section is dimensioned to transport a first pair of mutually orthogonally polarized $TE_{11}$ electromagnetic waves within a first, upper frequency band, such as Ka band, while the outer waveguide section is configured to transport a second pair of mutually orthogonally polarized $TE_{11}$ electromagnetic waves within a second, relatively lower, frequency band, such as X band.

In order to interface a pair of orthogonally polarized, upper (Ka) band, $TE_{11}$ mode signals with the interior hollow section of longitudinal waveguide, axially displaced sidewall portions of a first end thereof are respectively launched to first and second radially coupled ports of a first orthomode transducer (OMT). These axially displaced sidewall portions of the interior waveguide are also mutually spatially rotated (by 90°) about the feed's longitudinal axis in association with the respective polarizations of the RF signals interfaced by the two ports. At the distal end of the interior hollow waveguide section is the radiating aperture, interfacing with freespace, in the form of a dielectric plug having a preferably conically tapered surface inserted into the waveguide for impedance matching.

The outer coaxial waveguide section extends between a first end wall, that is axially spaced from the first end of the interior waveguide section to a distal end adjacent to the distal end of the interior waveguide section. For interfacing a pair of orthogonally polarized lower (X) band $TE_{11}$ mode signals and controlling the higher order modes, a reduced diameter portion of the outer waveguide section adjacent to its end wall is radially coupled with a third port, while a fourth port is radially coupled to a sidewall of the reduced diameter portion of the outer waveguide section that is axially displaced and spatially rotated (by 90°) about the feed's longitudinal axis relative to the third port. The third and fourth ports comprise a second coaxial waveguide OMT. As with the first and second ports of the first OMT for the interior hollow-waveguide section, orthogonal spatial separation between the third and fourth ports of the second coaxial waveguide OMT provides isolation for mutually orthogonally polarized RF signals interfaced thereby.

Dominant TEM mode RF signals that would otherwise be inherently injected into the outer coaxial-waveguide section, due to the presence of the conductive wall of the axially coincident interior or inner waveguide section, are effectively suppressed in the immediate vicinity of the third and fourth ports by the configuration of the side walls and the end wall adjacent to the feed launchers of the coaxial waveguide OMT, and by a TEM mode suppressor installed in the axial separation region between the third and fourth ports, which also provides isolation between these two ports. Suppression of the lower order TEM mode in the vicinity of the two ports of the outer coaxial-waveguide section facilitates interfacing of the mutually orthogonally polarized $TE_{11}$ components of the lower band signals with the outer waveguide section.

The dominant TEM mode is otherwise allowed to form and propagate in remaining portions of the outer waveguide section, to take advantage of its inherent difference lobe radiation pattern as an auxiliary channel that can be used for spatial tracking. Launching for this auxiliary TEM mode tracking channel may be readily effected by a sidewall-coupling of a section of coaxial cable.

Axially contiguous with the reduced diameter axial portion of the outer waveguide section to which the lower band ports are radially coupled, the outer waveguide section is stepped up to a wider diameter, coaxially configured transmission (preferably, but not limited to) cylindrical segment, that contains a broadband coaxial compensated polarizer. This transmission line segment includes a high band hollow waveguide $TE_{11}$ mode polarizer installed in the interior longitudinal waveguide section, and a low band coaxial waveguide $TE_{11}$ mode polarizer installed in the outer waveguide section.

The coaxial waveguide compensated polarizer includes dielectric phase shift elements that radially extending between an outer waveguide and the interior waveguide. Conductive phase shift pins or posts project radially inwardly from the outer waveguide and/or outwardly from the interior waveguide at locations spatially orthogonal to the dielectric phase shift elements. In a hollow waveguide configuration, a generally vane shaped dielectric phase shift element extends across a diameter line of the waveguide, while a set of conductive phase shift pins project radially inwardly from the outer waveguide at locations spatially orthogonal to the dielectric phase shift element.

Adjoining the coaxial-waveguide compensated polarizer segment of the feed, the diameter of the outer waveguide section is further stepped up to a distal, cylindrical waveguide segment, that is preferably configured as a coaxial Potter horn terminating adjacent to the distal end of the interior waveguide section, which is terminated in a dielectric polyrod antenna operating at the high band, also adjoining a hollow waveguide-compensated polarizer. A dielectric wafer that conforms with the interior diameter of and fits within the Potter horn includes a central aperture through which the interior waveguide section passes, to maintain coaxial radial spacing between the interior longitudinal hollow waveguide section and the coaxial outer waveguide section, and also acts as a radome.

This configuration provides for coincident phase centers for both the high band radiator and the low band radiator—an absolute requirement of dual band operation working in conjunction with and illuminating the same main reflector. Likewise, having equal beamwidths for both the low band radiator and the high band radiator provides for optimum illumination taper simultaneously in both bands. Furthermore, beam symmetry (in the E- and H-planes) of the coaxial Potter horn and the beam symmetry of the polyrod antenna provide for efficient illumination of the main reflector, also maintaining low cross-polarization components in the beam patterns.

BRIEF DESCRIPTION OF THE DRAWINGS

FIG. 4 is a diagrammatic end view of the coaxial multi-band tracking feed shown in perspective in FIG. 1;

FIG. 5 is an enlarged partial side view of the coaxial multi-band tracking feed of FIG. 1;

FIG. 6 is an enlarged partial side view of the feed architecture of FIG. 1, showing a port for an auxiliary TEM mode tracking channel;

FIG. 7 is an enlarged partial side view of the cylindrically configured coaxially compensated polarizer segment of the feed architecture of FIG. 1;

DETAILED DESCRIPTION

Figure 1:
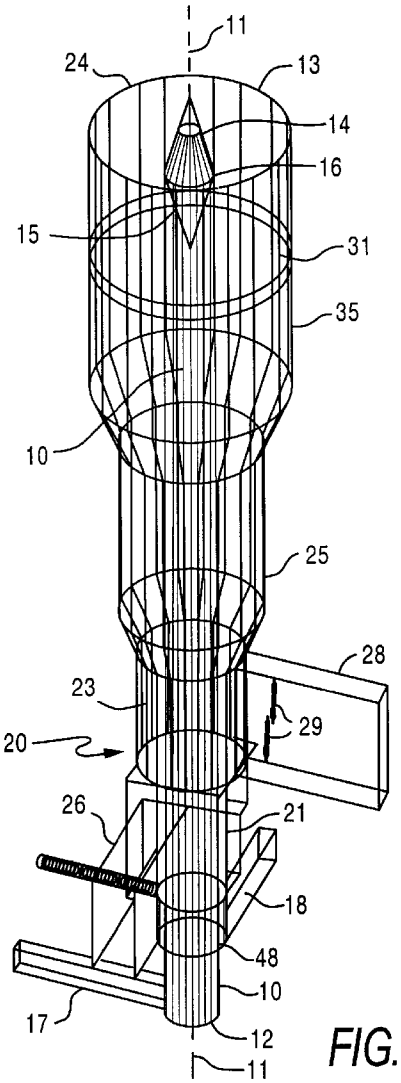
FIG. 1 is diagrammatic perspective view of the coaxial multi-band tracking feed of the present invention.
Figure 2:
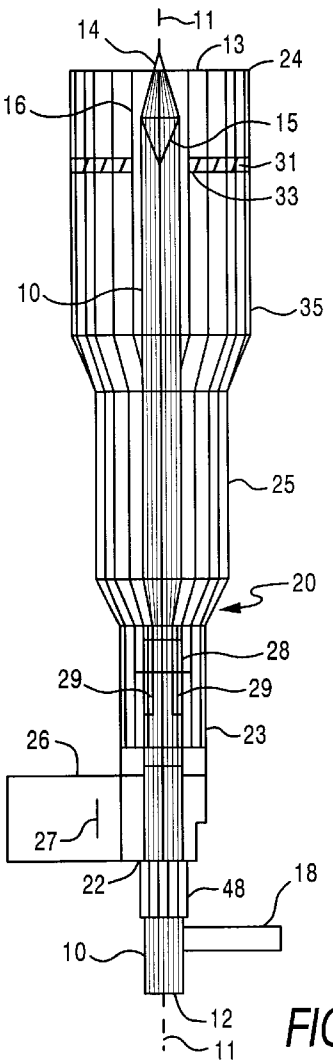
FIGS. 2 and 3 are respective side views of the coaxial multi-band tracking feed of FIG. 1.
Figure 3:
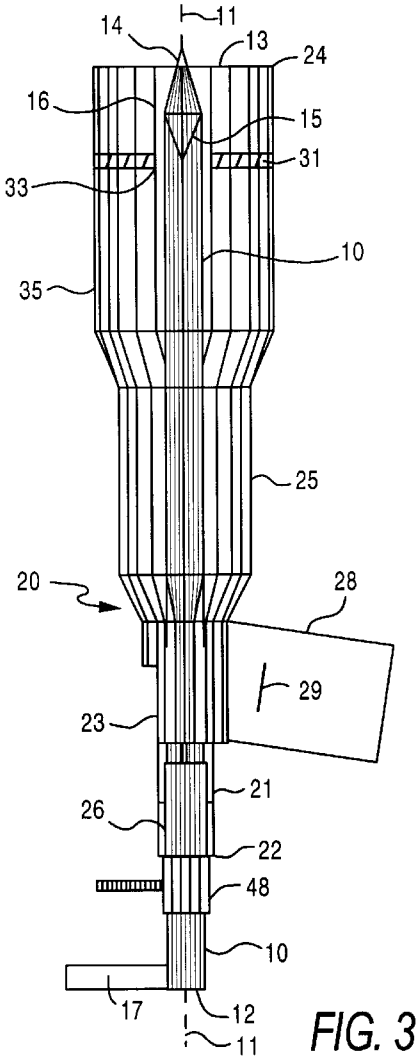
Figure 8:
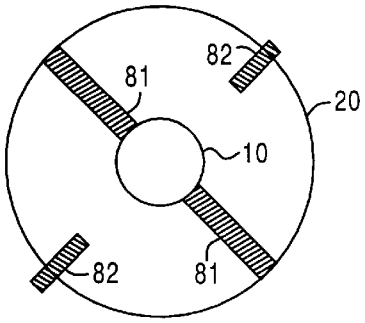
FIGS. 8–11 show end views of a coaxial waveguide configuration of a compensated polarizer.
Figure 9:
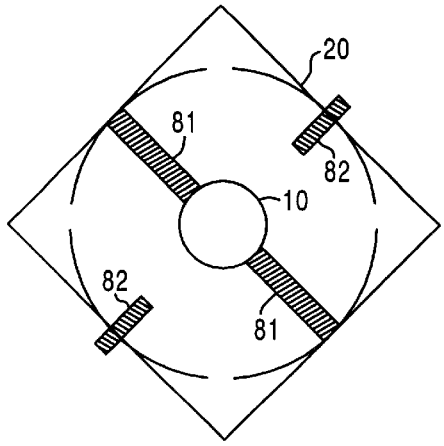
Figure 10:
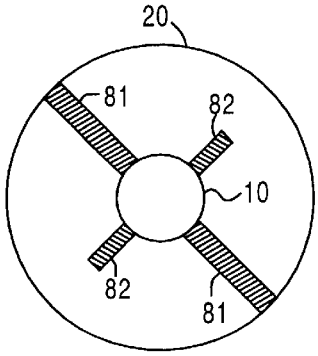
Figure 11:
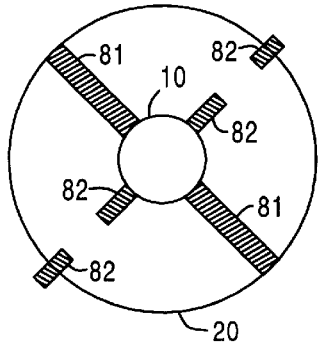

The coaxial multi-band tracking feed of the present invention is diagrammatically in the perspective view of FIG. 1 and the respectively rotated side views of FIGS. 2 and 3, as comprising a first, interior section of generally longitudinal hollow waveguide 10, that extends along a main longitudinal axis 11 of the feed, between a first end 12 and a freespace-interfacing, distal end 13 thereof. As a non-limiting example, the interior hollow waveguide section 10 may have a generally cylindrical configuration, shown in circular cross-section in the diagrammatic end view of FIG. 4. For impedance matching with freespace, a dielectric polyrod 14 having a dual conically tapered surface 15 is preferably inserted into the distal end 16 of the hollow waveguide section 10.

The interior hollow waveguide 10 is dimensioned to transport electromagnetic wave energy therethrough within a first, upper frequency band, such as Ka band, as a non-limiting example. For this purpose, axially displaced sidewall portions of the first end 12 of the interior waveguide section 10 are ported to first and second radially coupled ports 17 and 18 that comprise a first orthomode transducer (OMT). These axially displaced sidewall portions of the interior waveguide 10 are also mutually spatially rotated (by 90°) about the feed's longitudinal axis 11 in association with respective polarizations of the RF signals interfaced by the ports 17 and 18.

By interface RF signals is meant either coupling RF signals supplied by upstream transmitter circuitry in transmit mode to the waveguide for launch thereby of freespace electromagnetic waves at the distal end of the waveguide, or coupling RF signals from the waveguide to downstream signal processing circuitry, such as a low noise amplifier (LNA), in receive mode, of incoming electromagnetic waves that have been focussed upon the distal end of the waveguide by an associated reflector structure.

In order for the feed to support a second, relatively lower frequency band (such as X band), the interior longitudinal hollow waveguide section 10 is surrounded by a second, outer section of generally hollow, stepped waveguide 20, that is coaxial with the interior waveguide section 10. The second, outer waveguide section 20 extends between an end wall 22 thereof, that is axially spaced from the first end 12 of the interior waveguide section 10, to a second, distal end 24 thereof adjacent to the distal end 13 of the interior waveguide section 10.

A third port 26, which may include one or more interior tuning stubs 27 is radially coupled to a first, reduced diameter axial portion 21 of the outer waveguide section 20, adjacent to the end wall 22. The third port 26 serves as a first lower band launcher, for interfacing second RF signals lying in the second, lower frequency band. Axially displaced and spatially rotated (by 90°) about the longitudinal axis 11 relative to the third port 26 is a fourth port 28, that is radially coupled to a second axial portion 23 of outer waveguide section 20. The third port 26 and fourth port 28 comprise a second, coaxial waveguide OMT. Like port 26, the port 28 may include one or more tuning stubs 29, and is also configured to interface RF signals lying in the second, lower frequency band, but which are polarized orthogonally relative to RF signals interfaced with the outer waveguide section 20 by the port 26. This spatially orthogonal separation of ports 26 and 28 provides mutual (orthogonal polarization-based) isolation between RF signals interfaced thereby with outer waveguide section 20.

Advantageously, this coaxial dual band feed architecture produces the same E-plane and H-plane patterns (with coincident phase centers) within and between the interior (axial) and outer (coaxial) waveguide sections. Moreover, the interior and outer waveguide sections have very low cross-polarization and low sidelobes in all planes. This dual polarization and wideband frequency diversity enables the coaxial feed architecture of the invention to simultaneously support two pairs of transmit and receive channels. When this four-port feed is coupled with a pair of transfer switches, and two pairs of receive and transmit filter, comprising a diplexer, it becomes an eight port feed.

Thus, the feed architecture of the invention provides the ability to simultaneously or individually perform the following functionalities, without exchanging, moving or removing any parts: receive in two orthogonal polarizations in the low frequency band (e.g., X-band); transmit in two orthogonal polarizations in the low frequency band (e.g., X-band); receive in two orthogonal polarizations in the high frequency band (e.g., Ka-band); and transmit in two orthogonal polarizations in the high frequency band (e.g., Ka-band).

A further benefit of the above-described properties of the invention is that, when used to illuminate the same reflector or subreflector (such as that of a ring-focus antenna), the critical balance between spillover and illumination taper can be maintained across the entire operational bandwidth. This also holds true where the reflector and subreflector are 'shaped' for maximum efficiency. As a non-limiting example, the multimode feed of the invention may provide a taper on the order of 10 dB at 45° off boresight as, would be prescribed for a focal length to diameter ratio (F/D) of 0.6 in a typical prime focus arrangement.

Dominant TEM mode RF signals and other higher order modes that would otherwise be inherently launched into the outer waveguide section 20 in the vicinity of the ports 26 and 28 are effectively suppressed by the presence of the end wall 22 immediately adjacent to the radial feed port 26, by the two steps in the subsections 21 and 23 of the section 20, and by installing a mode suppressor in the axial separation region between the ports 26 and 28. As shown in the end view of FIG. 4 and the enlarged partial side view of FIG. 5, this mode suppressor may be configured as a generally solid conductive wall or fin 32, that is aligned with the port 26 and extends radially between the interior waveguide section 10 and the outer waveguide section 20. This arrangement successfully launches the coaxial $TE_{11}$ mode alone that is vital for the launching, transmission and radiation of the sum pattern signals.

As pointed out above, suppression of the dominant TEM mode is employed in the vicinity of the ports 26 and 28 to facilitate interfacing of the mutually orthogonally polarized components of the lower band signals with the outer waveguide section 20. The dominant TEM mode is otherwise allowed to form and propagate in remaining portions of the outer waveguide section 20, to take advantage of its inherent difference lobe radiation pattern as an auxiliary channel that can be used for spatial pointing (tracking). As further diagrammatically illustrated in the enlarged partial side view of FIG. 6, launching for this auxiliary TEM mode tracking channel signal may be effected by means of a sidewall or radial coupling 41 of a section of coaxial cable 43 to difference pattern processing circuitry 45. A narrow coaxial sleeve 48 assures that all other modes are cut off, and that the TEM mode transitions to the main coaxial waveguide section 20.

The TEM-mode difference pattern is a single, circularly symmetric pattern with a null on boresight, so that there are not separate difference patterns for azimuth and elevation. This allows any two arbitrary orthogonal planes to be selected. The difference pattern signal is sampled in the difference pattern processing circuitry 45 corresponding to a positional reference signal P. The positional reference signal P with two orthogonal components PA and PB can resolve the total difference pattern to two of its components DA and DB. Based upon the change in the reference signals PA and PB (either in the positive or negative direction), the difference signals can be further resolved into A+, A−, B+ AND B−, to provide an output correction signal to an antenna controller 47, so as to maintain the orientation of the antenna reflector, to which the coaxial multimode, dual band feed of the invention is coupled, aligned with boresight.

The polarization of the TEM-mode difference pattern is linear polarization, with its axis always being normal to the axis of the feed. However, at some point off the feed axis, the phase of this linear polarization has a fixed relationship to the phase of the main beam irrespective of whether the main beam is circularly polarized or linearly polarized. By coupling to the feed a phase comparator (coherent demodulator) that compares the phase at the coaxial TEM tracking port 41 to two orthogonal main beam ports, it is possible to determine the orientation of the antenna's angular pointing error off boresight, and correct this pointing error using only a single measurement, rather than requiring two consecutive measurements, as in the amplitude-only sampling scheme described above.

Axially contiguous with the reduced diameter axial portion 21, the diameter of the outer waveguide section is stepped up to a cylindrically configured, compensated polarizer segment 25, shown in the enlarged partial side view of FIG. 7 and in the end views of FIGS. 8–13, described below. As shown in the enlarged partial side view of FIG. 7, within the compensated polarizer segment 25, a high band hollow waveguide compensated polarizer 51, for the upper frequency band is installed in the interior longitudinal hollow waveguide section 10. In addition, a low band, coaxial compensated polarizer 52 for the upper frequency band is installed in the outer coaxial waveguide section. In these installations, the axial positions of the polarizers are not limited to any particular location.

The general problem faced in the design of a wideband polarizer intended for use for a waveguide feed of a reflector antenna with a very low axial ratio is to be able to provide complete satellite communication band coverage for both transmit and receive frequency bands. When covered separately a dual band device is required, and very low axial ratios are normally not possible over both operating bands. This problem becomes more acute if space is limited, as described above, requiring that the polarizer be made more compact. Existing polarizers, whether they use quarter wave dielectric plates or rows of irises or pins, are not intrinsically broadband devices, and are customarily made sufficiently long to realize marginal bandwidth.

Pursuant to a further aspect of the invention, the polarizer is also configured as a waveguide polarizer operating with coaxial waveguide modes. A coaxial circular waveguide (having a circularly symmetric cross-section) has Eigen-modes that are similar to but distinct from those of open center circular waveguides, generally called hollow waveguides. The Eigen-modes of other coaxial waveguides with different profiles of four-fold symmetry (square inner/circular outer, circular inner/square outer, and square inner/square outer conductors) also have Eigen-modes similar to but distinct from those of open center waveguides.

In the embodiment of FIGS. 8–11, the coaxial waveguide configuration includes dielectric phase shift elements 81 radially extending between an outer waveguide (shown as circular in FIG. 8 and square in FIG. 9) and the interior waveguide 10 coaxial therewith. FIGS. 8–11 also show conductive phase shift pins or posts 82 that project radially inwardly from the outer waveguide and/or outwardly from the interior waveguide 10, at locations spatially orthogonal to dielectric phase shift elements 81.

Figure 12:
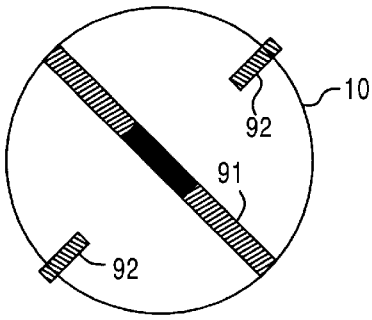
FIGS. 12–13 show end views of a hollow waveguide configuration of a compensated polarizer.
Figure 13:
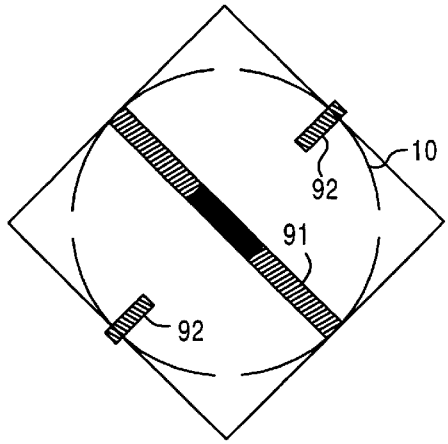

In the hollow waveguide embodiment of FIGS. 12 and 13, a generally vane shaped dielectric phase shift element 91 extends across a diameter line of the interior waveguide 10. Also a set of conductive phase shift pins or posts 92 projecting radially inwardly from the outer waveguide 20 (shown as cylindrical in FIG. 12 and square in FIG. 13) at locations spatially orthogonal to the phase shift element 91.

These compensated polarizer structures enjoy a relatively wide bandwidth of operation, based upon the different dispersion characteristics observed with dielectric vane polarizers versus that of pin polarizers. For any peak differential phase shift in the orthogonal planes, the dielectric vanes have a broader distribution over frequency crossing the 90° level farther part in frequency, compared to the pin polarizer's narrower distribution crossing the 90° level closer in between. As a result, when used in mutual opposition to one another (hence, the term 'compensated'), by overshooting the 90° degree phase differential over the major portion of the entire waveguide operational bandwidth with the dielectric polarizer, and compensating for the excess with the pin polarizer, it is possible to cross the 90° degree line four times, as diagrammatically illustrated in FIG. 14.

Figure 14:
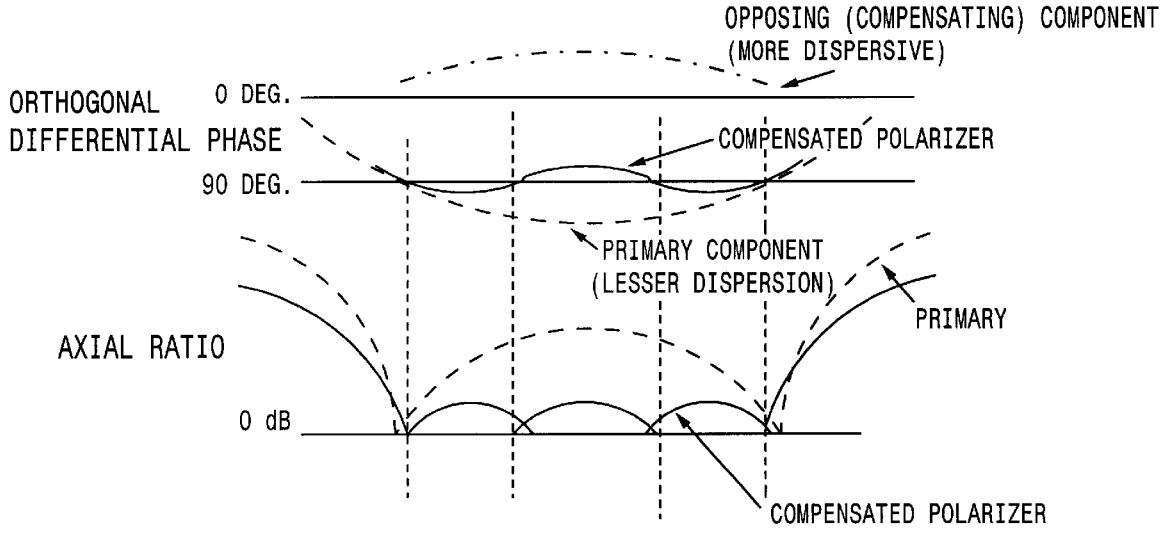
FIGS. 14 and 15 show respective performance characteristics of a single broad band and a dual band compensated polarizer.
Figure 15:
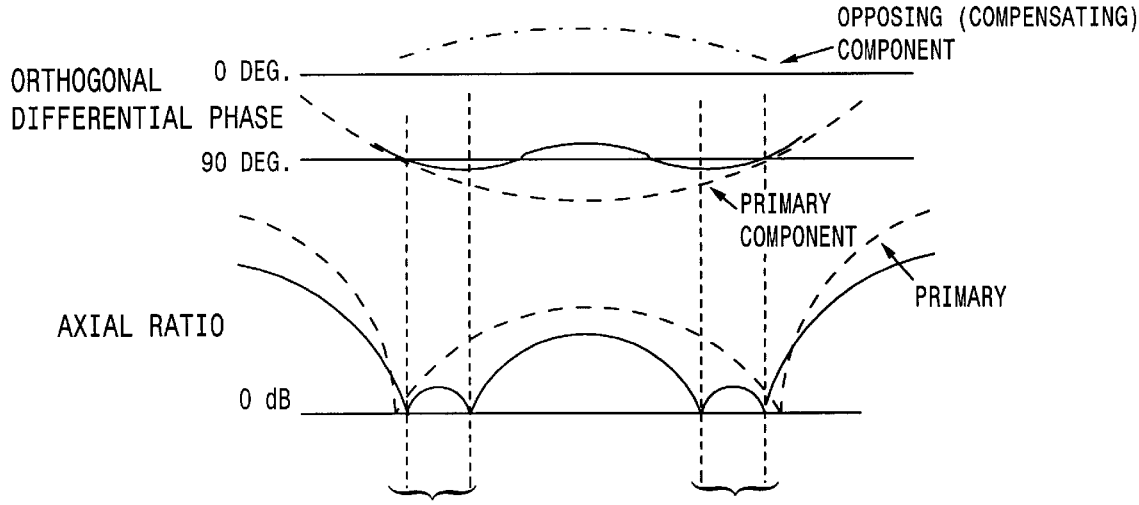

As further shown in FIG. 14, at each one of the cross-over frequencies, the axial ratio goes to zero dB. The extend of the differential phase overshoot and the extend of the compensation can be chosen so as to produce a maximally flat differential phase over a broad band. Alternatively, as shown in FIG. 15, the overshoot and compensation can be chosen so as to provide optimum axial ratio performance over two separate bands A and B.

Any polarizer employed for circular polarization must insert a differential phase shift of 90° in two orthogonal planes. However, from a practical standpoint, the inserted phase shift is almost never exactly 0° and 90° in the two planes, but rather some set of larger numbers whose difference (termed differential phase shift) is 90°. This results from the fact that any structure, whether it include conductive posts (pins) or dielectric plates, while intended to insert a phase shift in one plane only, will also introduce some incremental amount of phase shift in the other plane as well. This becomes evident in $TE_{11}$ field trajectories. The finite structure with a length profile intended to line up with and subtend the E-fields of one of the $TE_{11}$modes in one plane has an unintended width profile that subtends the E-fields of the other orthogonal mode in the orthogonal plane.

This excess phase shift is readily evident in the case of a dielectric plate polarizer. Unless the polarizer is infinitesimally thin, the bulk of the plate at the very center of the circular waveguide will insert approximately the same amount of phase shift in both of the orthogonal planes. This incremental phase shift contributes nothing to the differential phase shift; it only increases the base phase shift.

In order to be able to install a dielectric plate polarizer in a short length of waveguide section, the plate must have considerable thickness, so that its bulk will subtend a sufficient amount of E-fields. This thickness may be on the order of one-tenth of the width of the waveguide. The thinner the plate is, the longer it needs to be (and vice versa). To reduce reflections and impedance mismatch caused by the polarizer, its cross section should be as small as possible. Trying to fit a polarizer in a short length of waveguide will require a thicker plate—hence, a larger cross section.

For this reason, a polarizer that has no base phase shift will have the minimum cross section for a given length. As a result, in order to make the polarizer as short as practically possible with minimum impedance mismatch the bulk that does not contribute to the differential phase shift should be removed. A polarizer configuration that inherently achieves this characteristic for a coaxial waveguide is diagrammatically illustrated in the end views of FIGS. 8–11.

Adjoining the coaxial polarizer segment 25, the diameter of the outer waveguide section 20 is further stepped up to a distal cylindrical waveguide segment 35 which, in accordance with a preferred embodiment, is configured as a Potter horn that terminates adjacent to the distal end polyrod 14 of the interior waveguide section 10. The Potter horn segment 35 contains a dielectric wafer 31 of a diameter that conforms with the interior diameter of and fits within the Potter horn, and includes a central hole 33 through which the interior waveguide section passes. The dielectric disc 31 serves to maintain coaxial radial spacing between the interior longitudinal hollow waveguide section 10 and the surrounding outer waveguide section 20, and also as a weather shield (radome).

As will be appreciated from the foregoing description, the antenna feed architecture of the present invention provides a spatially integrated RF interface that is configured to support two pairs of mutually isolated transmit and receive channels. As a consequence, the invention can receive two orthogonal polarizations in the low frequency band, transmit two orthogonal polarizations in the low frequency band, receive two orthogonal polarizations in the high frequency band, and transmit two orthogonal polarizations in the high frequency band. In addition, the invention makes use of a locally suppressed but otherwise dominant TEM mode channel for difference pattern-based tracking.

While I have shown and described an embodiment in accordance with the present invention, it is to be understood that the same is not limited thereto but is susceptible to numerous changes and modifications as known to a person skilled in the art. I therefore do not wish to be limited to the details shown and described herein, but intend to cover all such changes and modifications as are obvious to one of ordinary skill in the art.

What is claimed is:

1. An electromagnetic wave interface device comprising:

a generally cylindrically nested waveguide structure including an inner section of generally longitudinal waveguide extending along an axis from a first end to a distal end thereof, and an outer stepped section of coaxial waveguide surrounding said inner section of generally longitudinal waveguide along said axis, said outer stepped section having an endwall axially displaced from the first end of the inner section of generally longitudinal waveguide toward the distal end thereof, said inner section of generally longitudinal waveguide having axially displaced sidewalls between the endwall of the outer stepped section of coaxial waveguide and the first end of the inner section of generally longitudinal waveguide;

a first electromagnetic wave transducer forming a first port of said inner section of generally longitudinal waveguide to interface therewith first signals having a frequency in a first frequency band;

a second electromagnetic wave transducer forming a second port of said inner section of generally longitudinal waveguide to interface therewith second signals having a frequency in said first frequency band, and mutually isolated from said first signals;

said first and second ports being located at the axially displaced sidewalls of the inner section of generally longitudinal waveguide;

a third electromagnetic wave transducer coupled to a first side portion of said outer stepped section of coaxial waveguide and forming a third port to interface said outer stepped section of coaxial waveguide with third signals having a frequency in a second frequency band spectrally spaced apart from said first frequency band; and a fourth electromagnetic wave transducer coupled to a second side portion of said outer stepped section of coaxial waveguide, spatially separated from said first side portion thereof and forming a fourth port to interface said outer stepped section of coaxial waveguide with fourth signals having a frequency in said second frequency band, and in a manner that provides mutual isolation between said third and fourth signals.

2. An electromagnetic wave interface device according to claim 1, wherein said first and second electromagnetic wave transducers comprise an orthomode transducer.

3. An electromagnetic wave interface device according to claim 1, wherein said third and fourth electromagnetic wave transducers comprise an orthomode transducer.

4. An electromagnetic wave interface device according to claim 1, wherein said outer stepped section of coaxial waveguide has a coaxial-mode horn configuration adjacent to an axial end of said inner section of generally longitudinal waveguide.

5. An electromagnetic wave interface device according to claim 1, wherein said first and second signals have mutually orthogonal polarizations, and said third and fourth signals have mutually orthogonal polarizations, and further including a compensated polarizer installed in said inner section of generally longitudinal waveguide and a coaxial compensated polarizer installed in said outer stepped section of coaxial waveguide.

6. An electromagnetic wave interface device according to claim 1, further including a mode suppression structure to suppress transverse electromagnetic mode (TEM) signals and higher order modes in said outer stepped section of coaxial waveguide in the vicinity of said third and fourth transducers coupled thereto.

7. An electromagnetic wave interface device according to claim 6, further including a tracking port to provide an output representative of transverse electromagnetic mode (TEM) energy generated and propagating in said outer stepped section of coaxial waveguide apart from the vicinity of said third and fourth transducers.

8. An electromagnetic wave interface device according to claim 1, wherein said dital end of said inner section of generally longitudinal waveguide includes a dielectric polyrod antenna.

9. An electromagnetic wave interface device according to claim 1, further including a tracking port to provide an output representative of transverse electromagnetic mode (TEM) signals generated in said outer stepped section of coaxial waveguide.

10. An electromagnetic wave interface device according to claim 9, wherein said tracking port is coupled to circuitry for processing a difference pattern signal provided by said tracking port, so as to provide a correction signal for controlling the orientation of an antenna containing said interface device.

11. A dual band multimode coaxial feed structure for a reflector antenna comprising:

an inner section of generally longitudinal hollow waveguide extending along an axis from a first end to a distal end thereof, and having first and second orthomode electromagnetic wave transducers respectively forming first and second radial ports of said dual band multimode coaxial feed structure to interface therewith first and second ($TE_{11}$ mode) signals having a frequency in a first frequency band;

an outer stepped section of coaxial waveguide surrounding said inner section of generally longitudinal waveguide along said axis, and having a third radial port that includes a third orthomode transducer to interface third ($TE_{11}$ mode) signals having a frequency in a second frequency band lower than said first frequency band, and having a fourth radial port that includes a fourth orthomode transducer to interface fourth ($TE_{11}$ mode) signals having a frequency in said second frequency band, while providing mutual electromagnetic isolation between said third and fourth ($TE_{11}$ mode) signals, said outer stepped section having an endwall axially displaced from the first end of the inner section of generally longitudinal hollow waveguide toward the distal end thereof; and a tracking port to provide an output representative of transverse electromagnetic mode (TEM) signals generated and propagating in said outer stepped section of coaxial waveguide;

said inner section of generally longitudinal hollow waveguide having axially displaced sidewalls between the endwall of the outer stepped section of coaxial waveguide and the first end of the inner section of generally longitudinal waveguide, and said first and second ports being located at the axially displaced sidewalls of the inner section of generally longitudinal waveguide.

12. A dual band multimode coaxial feed horn structure according to claim 11, further including circuitry for processing a difference pattern signal provided by said tracking port, to provide a correction signal for controlling the orientation of an antenna containing a reflector fed by said dual band multimode coaxial feed horn structure.

13. A dual band multimode coaxial feed horn structure according to claim 12, further including a mode suppression structure to suppress fundamental transverse electromagnetic mode signals in said outer stepped section of coaxial waveguide in the vicinity of said first and second radial ports thereof.

14. A dual band multimode coaxial feed horn structure according to claim 11, wherein said first and second signals have mutually orthogonal polarizations, and wherein said third and fourth signals have mutually orthogonal polarizations, and further including a compensated polarizer installed in said inner section of generally longitudinal hollow waveguide, and a coaxial compensated polarizer installed in said outer stepped section of coaxial waveguide.

15. A dual band multimode coaxial feed horn structure according to claim 14, wherein said outer stepped section of coaxial waveguide terminates in a coaxial-mode horn configuration.

16. A dual band multimode coaxial feed horn structure according to claim 11, wherein said inner section of generally longitudinal hollow waveguide is terminated by a conically tapered dielectric polyrod.

17. A method of interfacing electromagnetic energy with an antenna reflector comprising the steps of:

(a) providing a dual band multimode electromagnetic energy coupling interface that includes an inner section of generally longitudinal hollow waveguide extending along an axis from a first end to a distal end thereof, and having a first port coupled to a first electromagnetic wave transducer to interface first signals having a frequency in a first frequency band, and a second port coupled to a second electromagnetic wave transducer to interface second signals having a frequency in said first frequency band and being orthogonally polarized relative to said first signals, and an outer stepped section of coaxial waveguide surrounding said inner section of generally longitudinal waveguide along said axis to form a coaxial waveguide structure therewith, and having a third port radially coupled to a third electromagnetic wave transducer to interface third signals having a frequency in a second frequency band spectrally spaced apart from said first frequency band, and a fourth port radially coupled to a fourth electromagnetic wave transducer to interface fourth signals having a frequency in said second frequency band and being orthogonally polarized with said third signals, said outer stepped section having an endwall axially displaced from the first end of the inner section of generally longitudinal hollow waveguide toward the distal end thereof, said inner section of generally longitudinal hollow waveguide having axially displaced sidewalls between the endwall of the outer stepped section of coaxial waveguide and the first end of the inner section of generally longitudinal waveguide, and said first and second ports being located at the axially displaced sidewalls of the inner section of generally longitudinal waveguide; and (b) operating said dual band multimode electromagnetic energy coupling interface to perform at least one of the following actions:

transmitting two orthogonally polarized signals in said first frequency band, receiving two orthogonally polarized signals in said first frequency band, transmitting two orthogonally polarized signals in said second frequency band, and receiving two orthogonally polarized signals in said second frequency band.

18. A method according to claim 17, wherein said dual band multimode electromagnetic energy coupling interface includes a tracking port to generate an output representative of transverse electromagnetic mode (TEM) signals generated in said outer stepped section of coaxial waveguide, and further including the step (c) of processing a difference pattern signal provided by said tracking port, to provide a correction signal for controlling the orientation of said antenna reflector.

19. A method according to claim 18, further including a mode suppressor to suppress TEM signals in said outer stepped section of coaxial waveguide in the vicinity of said third and fourth transducers.

* * * * *

UNITED STATES PATENT AND TRADEMARK OFFICE

CERTIFICATE OF CORRECTION

PATENT NO. : 6,323,819 B1
DATED : November 27, 2001
INVENTOR(S) : Ahmet Ergene

It is certified that error appears in the above-identified patent and that said Letters Patent is hereby corrected as shown below:

Column 2,
Line 1, delete "described the" insert -- described in the --
Line 23, delete "each on of" insert -- each one of --
Line 50, delete "much high" insert -- much higher --
Lines 65-66, delete "what may referred to" insert -- what may be referred to --

Column 4,
Line 27, delete "extending" insert -- extend --

Column 6,
Line 29, delete "filter," insert -- filters, --

Column 8,
Line 42, delete "farther part" insert -- farther apart --

Column 11,
Line 12, delete "dital" insert -- distal --

Signed and Sealed this

Twenty-sixth Day of March, 2002

*Attest:*

*Attesting Officer*

JAMES E. ROGAN
*Director of the United States Patent and Trademark Office*